US005316340A

United States Patent [19]

Maltsev

[11] Patent Number: 5,316,340

[45] Date of Patent: May 31, 1994

[54] SKI STICK FOR SKATING STRIDE

[76] Inventor: Alexandr A. Maltsev, korpus 415, kv. 23 Moscow,

[21] Appl. No.: 941,146

[22] PCT Filed: Feb. 3, 1992

[86] PCT No.: PCT/SU92/00026

§ 371 Date: Nov. 12, 1992

§ 102(e) Date: Nov. 12, 1992

[87] PCT Pub. No.: WO92/13612

PCT Pub. Date: Aug. 20, 1992

[30] Foreign Application Priority Data

Feb. 4, 1991 [SU] U.S.S.R. ..... 4907599

[51] Int. Cl.[5] ..... A63C 11/22

[52] U.S. Cl. ..... 280/821

[58] Field of Search ..... 280/819, 821, 822, 824; 135/65, 72

[56] References Cited

U.S. PATENT DOCUMENTS

| | | | |
|---|---|---|---|
| 3,436,090 | 4/1969 | Lange et al. | 280/821 |
| 3,658,356 | 4/1972 | Van Reyper | 280/822 |
| 4,750,760 | 6/1988 | Gurley | 280/821 |
| 4,775,168 | 10/1988 | Dalebout | 280/822 X |
| 4,790,562 | 12/1988 | Skard | 280/821 |

FOREIGN PATENT DOCUMENTS

| | | |
|---|---|---|
| 0266329 | 8/1990 | European Pat. Off. . |
| WO80/02649 | 12/1980 | World Int. Prop. O. . |
| WO90/14136 | 11/1990 | World Int. Prop. O. . |

*Primary Examiner*—Margaret A. Focarino
*Assistant Examiner*—Michael Mar
*Attorney, Agent, or Firm*—Keck, Mahin & Cate

[57] ABSTRACT

A ski stick for skating stride comprising a rod (1) with a supporting basket (2) at one end thereof and a handle (3) at the other end. The handle (3) consists of being interconnected a tube (4) and a cross-piece (5) with two portions (6, 7) of different lengths. The larger portion (6) intended for placing a palm is inclined to the axis (8) of the tube (4) at an acute angle ($\alpha$) and, as seen from above, is oriented at an obtuse angle ($\beta$) in relation to the smaller portion (7) and swung to the side opposite to where the strap attaching means (10) is located. The handle (3) also comprises a boss (9) projecting above the cross-piece (5) and displaced toward the smaller portion (7) of the cross-piece (5) relative to the axis (8) of the tube (4). The horizontal axis (11) of the boss (9) lying in its cross-section perpendicular to the axis (8) of the tube (4) is offset relative to the horizontal axis (12) of the tube (4).

3 Claims, 2 Drawing Sheets

SKI STICK FOR SKATING STRIDE

FIELD OF INVENTION

This invention relates to the production of sports equipment, and more particularly to the production of ski sticks for skating stride.

PRIOR ART

Known in the art is a ski stick for skating stride (see EP No. 0266329, cl. A63C 11/22, 1988) comprising a rod with a supporting basket at one end thereof and a handle at the other end the latter consisting of being interconnected a tube, a cross-piece with two portions of different lengths of which the larger portion intended for placing a palm is inclined to the tube axis at an acute angle, and a boss projecting above the cross-piece, displaced toward the smaller portion of the cross-piece relative to the tube axis, and having a means for attaching a hand strap.

This already known ski stick allows to increase skiing speed. However, the skier's hand pressure acting on the ski stick handle turns out to be offset relative to the rod axis, and this requires an additional energy to be spent by the skier to bend the rod.

SUMMARY OF INVENTION

It is the principal object of the present invention to provide a ski stick for skating stride which would allow to align the rod axis and the line of hand pressure action and thus prevent the rod from bending sideward.

The essence of the present invention is that in a ski stick for skating stride the horizontal axis of the boss lying in its cross-section perpendicular to the tube axis is offset relative to the horizontal axis of the tube to enable positioning of the boss with a displacement toward the skier's hand grip, and that the larger portion of the cross-piece, as seen from above, is oriented at an obtuse angle in relation to the smaller portion and swung toward the side opposite to where the strap attaching means is located.

It is of advantage to have the angle of inclination of the larger portion of the cross-piece to the tube axis in the range of 30° to 60° and the angle between the larger and smaller portions of the cross-piece in the range of 140° to 150°.

It is also of advantage to coat the handle with an elastic foamed synthetic material.

The present invention allows to increase the skiing speed with the same skier's energy spent and also to improve the ski stick ergonomic properties.

BRIEF DESCRIPTION OF DRAWINGS

The invention will now be further explained with reference to a preferred embodiment thereof taken in conjunction with the accompanying drawings, wherein.

PREFERRED EMBODIMENT OF INVENTION

Figure 1:
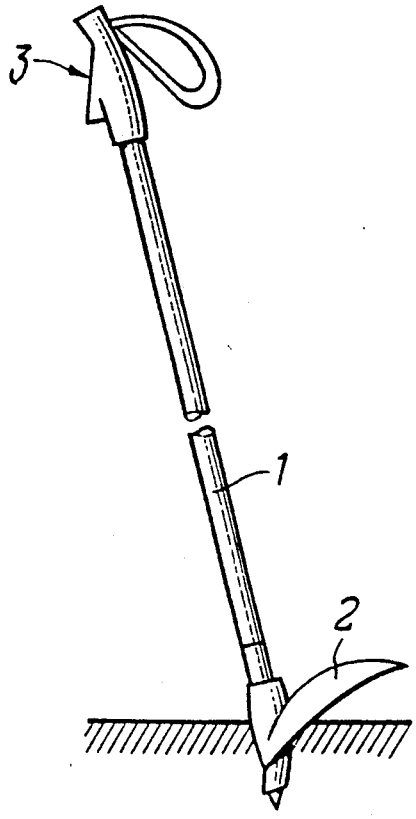
FIG. 1 is a three-dimensional view of a ski stick for skating stride in accordance with the present invention.
Figure 2:
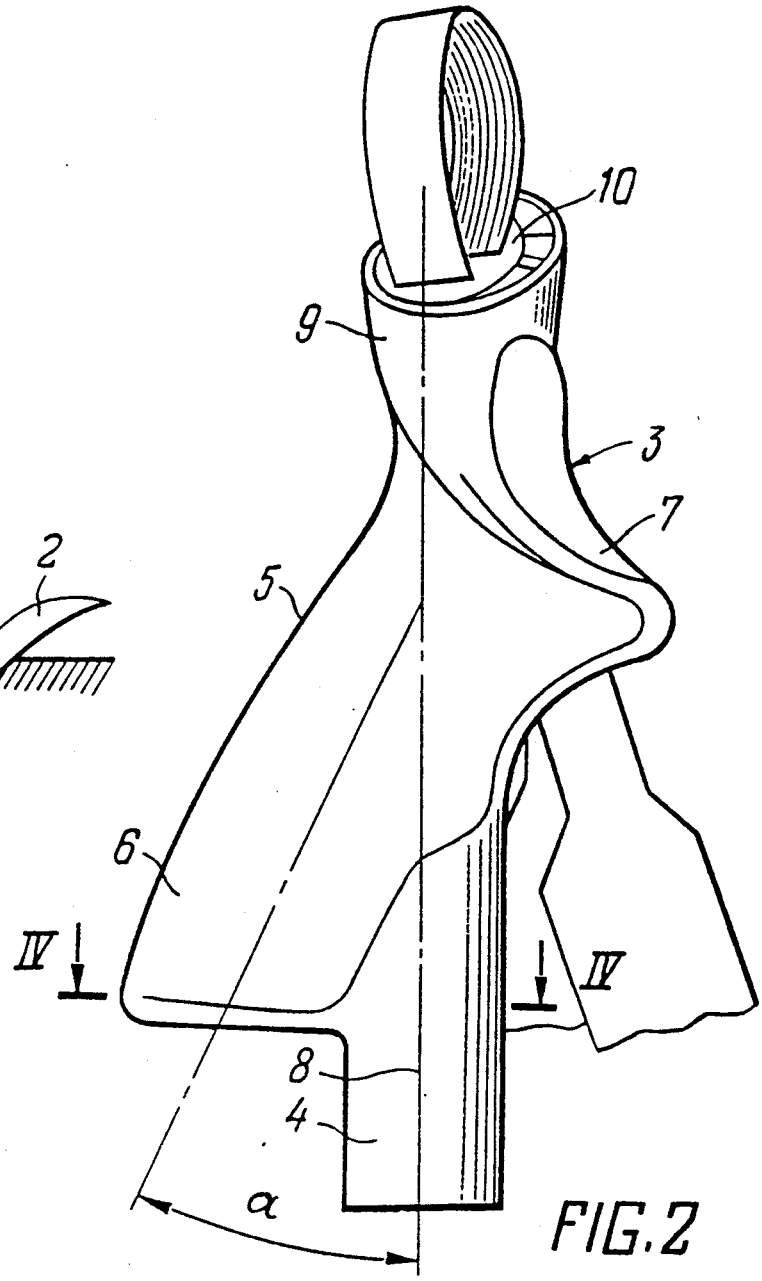
FIG. 2 is a front view of the right hand handle of the ski stick in accordance with the present invention.

A ski stick for skating stride (FIG. 1) comprises rod 1 with supporting basket 2 at one end thereof and handle 3 at the other end the latter (FIG. 2) consisting of being interconnected tube 4, cross-piece 5 with two portions of different lengths of which larger portion 6 intended for placing a palm is inclined to axis 8 of tube 4 at acute angle $\alpha$, and boss 9 projecting above cross-piece 5, displaced toward smaller portion 7 of cross-piece 5 relative to axis 8 of tube 4, and having means 10 for attaching a hand strap.

Horizontal axis 11 of boss 9 lying in its cross-section perpendicular to axis 8 of tube 4 is offset relative to horizontal axis 12 of tube 4 to enable positioning of boss 9 with a displacement toward the skier's hand grip.

Figure 3:
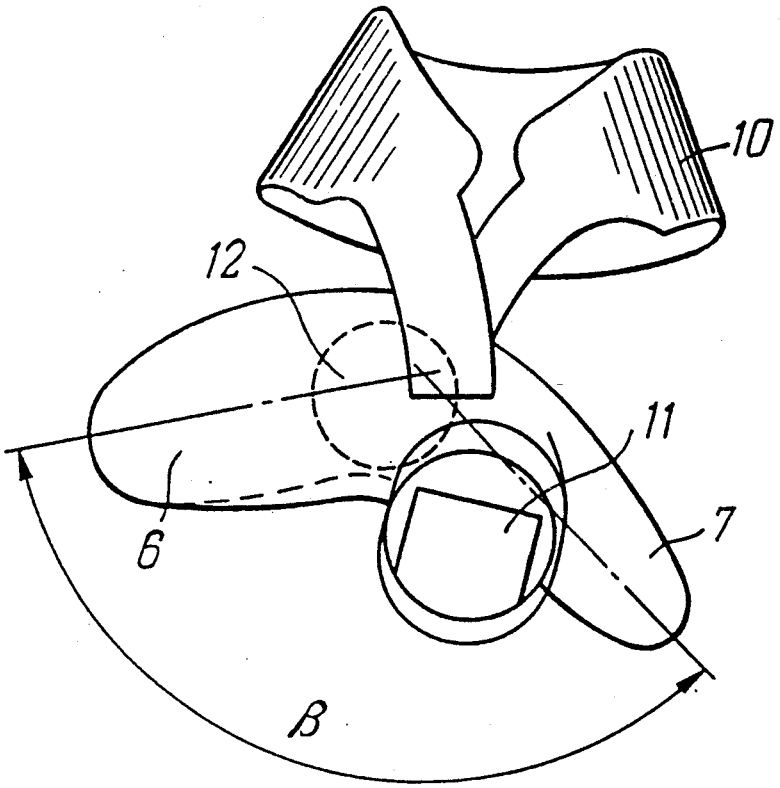
FIG. 3 is a top view of the right hand handle of the ski stick in accordance with the present invention.

Larger portion 6 of cross-piece 5, as seen from above (FIG. 3), is oriented at obtuse angle $\beta$ in relation to smaller portion 7 and swung toward the side opposite too where strap attaching means 10 is located.

Angle of inclination $\alpha$ (FIG. 2) of larger portion 6 of cross-piece 5 to axis 8 of tube 4 is in the range of 30° to 60°, and angle $\beta$ (FIG. 3) between larger portion 6 and smaller portion 7, as seen from above, is in the range of 140° to 150°.

Figure 4:
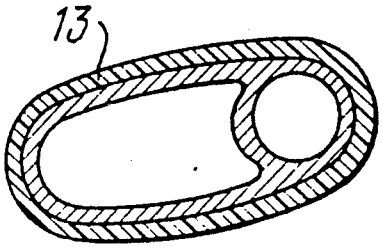
FIG. 4 is a cross-sectional view along line A—A in FIG. 2 in accordance with the present invention.

Handle 3 is coated with elastic foamed synthetic material 13 (FIG. 4).

The ski stick is used as follows.

After fixing his/her hands with the ski stick straps and grasping cross-piece 5, the skier starts moving and pushing with the ski sticks.

While moving, the hands of the skier occupy the positions which are very close to those they would have occupied in case of conventional cross-country skiing. Hence, no special training is required for using the ski sticks of the present invention.

At the same time the skier's hand pressure acting on handle 3 turns out to be applied along axis 8 of rod 1.

Thus, the skier's speed can be increased thanks to more effective usage of his/her energy.

I claim:

1. A ski pole for skating stride comprising a rod with a supporting basket attached at a lower end thereof and a handle attached at an upper end thereof, the handle having a tube at a lower end for receiving the upper end of the rod, a cross-piece of the handle having a larger portion and a smaller portion extending outwardly therefrom, the larger portion having an inclined surface extending forwardly and downwardly at an acute angle with respect to a vertical axis of the tube, and a boss projecting above the cross-piece and being displaced relative to the axis of the tube towards the smaller portion, the boss having means for attaching a hand strap thereto, wherein a horizontal cross-section of the boss is offset relative to a horizontal cross-section of the tube with respect to the axis of the tube and the larger and smaller portions of the cross-piece are oriented at an obtuse angle with respect to each other about the axis of the tube.

2. A ski pole according to claim 1, wherein the larger portion has an angle of inclination with respect to the tube axis in the range of 30 to 60 degrees and the obtuse angle between the larger portion and the smaller portion is in the range of 140–150 degrees.

3. A ski pole according to claim 1, wherein the handle is coated with an elastic foamed synthetic material.

* * * * *